US011207900B2

(12) United States Patent
Masuda et al.

(10) Patent No.: US 11,207,900 B2
(45) Date of Patent: Dec. 28, 2021

(54) RECORDING DEVICE AND RECORDING METHOD FOR CONTROLLING A MEDIUM HEATER

(71) Applicant: SEIKO EPSON CORPORATION, Tokyo (JP)

(72) Inventors: Norihiro Masuda, Shiojiri (JP); Yoshitaka Shimada, Matsumoto (JP); Yutaka Nagashima, Yamagata-mura (JP)

(73) Assignee: Seiko Eoson Corporation, Tokyo (JP)

( * ) Notice: Subject to any disclaimer, the term of this patent is extended or adjusted under 35 U.S.C. 154(b) by 0 days.

(21) Appl. No.: 16/797,282

(22) Filed: Feb. 21, 2020

(65) Prior Publication Data

US 2020/0269607 A1 Aug. 27, 2020

(30) Foreign Application Priority Data

Feb. 22, 2019 (JP) ..... JP2019-030231

(51) Int. Cl.
*B41J 11/00* (2006.01)

(52) U.S. Cl.
CPC ..... *B41J 11/002* (2013.01)

(58) Field of Classification Search
CPC ..... B41J 11/002; B41J 11/00242; B41J 3/28; B41J 2/01; B41J 29/00
See application file for complete search history.

(56) References Cited

U.S. PATENT DOCUMENTS

2003/0161552 A1* 8/2003 Shima ..... B41J 11/00222 382/312
2012/0182336 A1 7/2012 Itoh et al.
2018/0229517 A1* 8/2018 Cloots ..... B41J 11/002
2018/0272766 A1* 9/2018 Wakita ..... B65H 23/048

FOREIGN PATENT DOCUMENTS

JP 2011-042087 3/2011

* cited by examiner

*Primary Examiner* — Bradley W Thies
(74) *Attorney, Agent, or Firm* — Workman Nydegger

(57) ABSTRACT

A recording device includes a medium placement unit on which a medium is fixedly placed, a recording head configured to discharge liquid toward the medium, a gantry including a discharging unit, the gantry being configured to move relative to the medium placement unit along a first axial direction, a heater provided at the medium placement unit, the heater being configured to heat the medium placed on the medium placement unit, and a control unit configured to control the heater. The control unit controls heating of the medium by the heater in accordance with a condition.

7 Claims, 6 Drawing Sheets

RECORDING DEVICE AND RECORDING METHOD FOR CONTROLLING A MEDIUM HEATER

The present application is based on, and claims priority from JP Application Serial Number 2019-030231, filed Feb. 22, 2019, the disclosure of which is hereby incorporated by reference herein in its entirety.

BACKGROUND

1. Technical Field

The present disclosure relates to a recording device that performs recording on a medium, and a method of recording on a medium.

2. Related Art

In some recording devices that perform recording on a medium, a recording head discharges ink (liquid) while moving with respect to a medium placed on a medium placement unit to perform recording on a medium.

For example, JP-A-2011-42087 discloses a recording device in which a printer head 20 serving as a recording head moves in the X-axis direction while moving in the Y-axis direction with respect to a flatbed 10 serving as a medium placement unit so as to perform recording.

In such a recording device, it is conceivable to provide a heating unit in the medium placement unit to heat the medium for the purpose of improving the fixing characteristic of the ink to the medium.

Since heating at the heating unit entails a relatively large amount of power consumption, the running cost of the device increases when a heating unit is provided at the recording device.

In addition, the amount of the liquid component on the medium after recording varies depending on the content of the recording, and is not always uniform. Therefore, when the medium is heated in a uniform heating state set for a recording with a large amount of liquid component, heating is performed more than necessary in recording with a small amount of liquid component, and consequently the running cost increases.

SUMMARY

To solve the above-described problems, a recording device according to the present disclosure includes a medium placement unit on which a medium is fixedly placed, a discharging unit configured to discharge liquid toward the medium placed on the medium placement unit, a moving unit including the discharging unit, the moving unit being configured to relatively move along a first axial direction with respect to the medium placement unit, one or more heating units provided at the medium placement unit, the one or more heating units being configured to heat the medium placed on the medium placement unit, and a control unit configured to control the one or more heating units, wherein the control unit controls heating of the medium by the one or more heating units in accordance with a condition.

DESCRIPTION OF EXEMPLARY EMBODIMENTS

Figure 1:
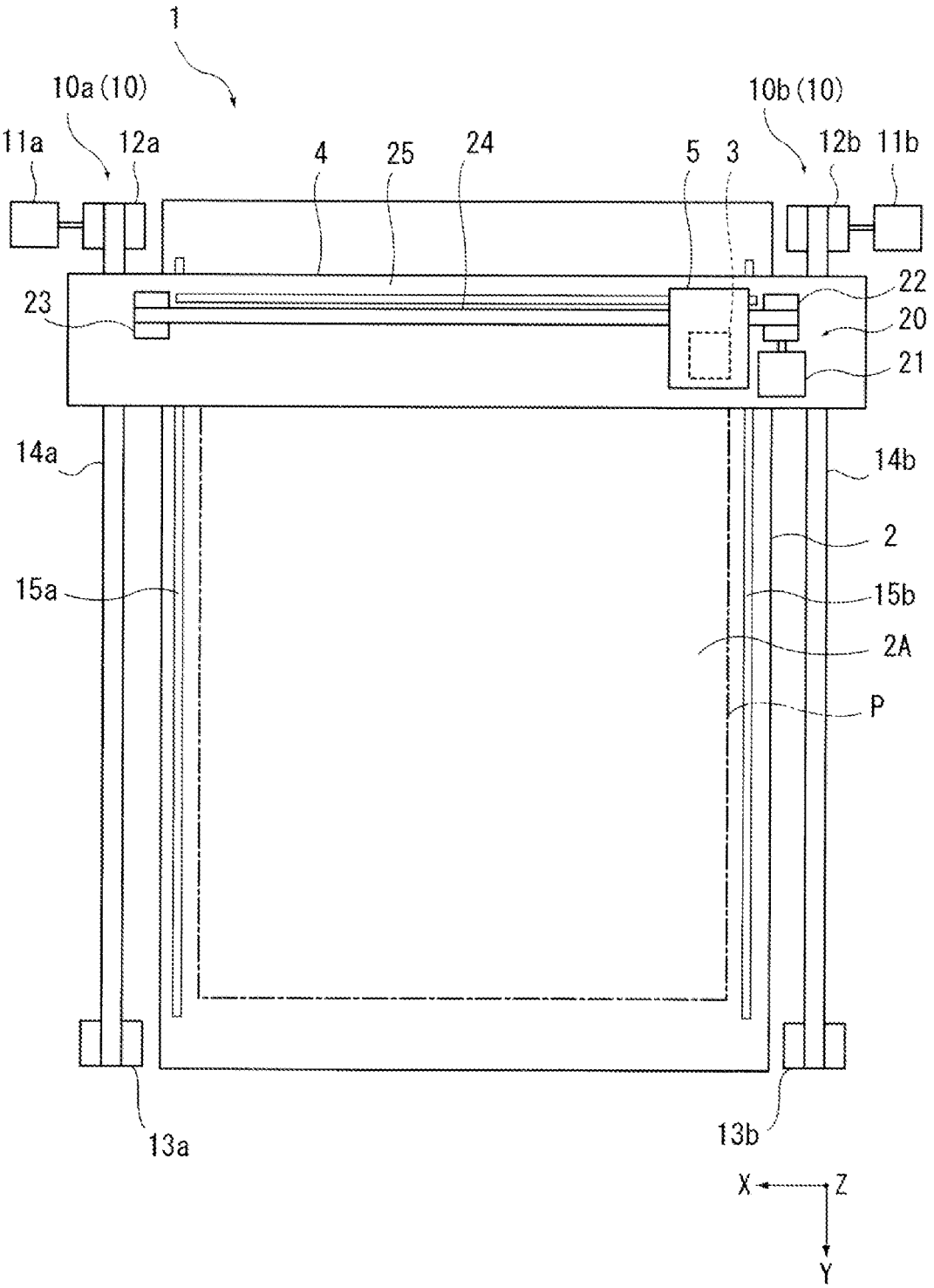
FIG. 1 is a schematic plan view illustrating a recording device according to a first exemplary embodiment.

Now, an overview of the present disclosure is described.

A first aspect includes a medium placement unit on which a medium is fixedly placed, a discharging unit configured to discharge liquid toward the medium placed on the medium placement unit, a moving unit including the discharging unit, the moving unit being configured to relatively move along a first axial direction with respect to the medium placement unit, one or more heating units provided at the medium placement unit, the one or more heating units being configured to heat the medium placed on the medium placement unit, and a control unit configured to control the one or more heating units. The control unit controls heating of the medium by the one or more heating units in accordance with a condition.

According to the present aspect, the control unit controls heating of the medium by the one or more heating units in accordance with a condition, and thus the medium placed on the medium placement unit can be appropriately heated by the heating unit, and the running cost of the device can be reduced.

In a second aspect, the plurality of heating units are provided side by side in at least one of the first axial direction and a second axial direction that intersects the first axial direction, and the control unit is configured to change a heating state of the plurality of heating units in at least one of the first axial direction and the second axial direction in the first aspect.

According to the present aspect, the plurality of heating units are provided side by side in at least one of the first axial direction and a second axial direction that intersects the first axial direction, and the control unit is configured to change a heating state of the plurality of heating units in at least one of the first axial direction and the second axial direction. Thus, for example, the medium can be more appropriately heated by changing the heating state of the plurality of heating units in at least one of the first axial direction and the second axial direction on the basis of the image data to be recorded to the medium, and the running cost of the device can be reduced.

In a third aspect, the control unit is configured to select, from among the plurality of heating units, a heating unit that overlaps, in the first axial direction and the second axial direction, the medium placed on the medium placement unit to heat the medium in the second aspect.

According to the present aspect, the control unit is configured to select, from among the plurality of heating units, a heating unit that overlaps, in the first axial direction and the second axial direction to heat the medium, the medium placed on the medium placement unit. Thus, the running cost of the device can be reduced by turning off the heating unit that does not overlap the medium and as such cannot easily transfer the heat to the medium.

In a fourth aspect, the control unit uses a type of the medium as the condition in the first to third aspects.

Examples of the type of the medium include the material, thickness, and basis weight of the medium. According to the present aspect, the control unit more appropriately heats the medium placed on the medium placement unit with the heating unit by using the type of the medium as the condition, and thus the recording can be achieved in consideration of both the improvement in fixing characteristic of the liquid to the medium and the reduction in running cost of the device.

In a fifth aspect, the control unit uses an amount of liquid discharged from the discharging unit to the medium as the condition in the first to fourth aspects.

According to the present aspect, the control unit more appropriately heats the medium placed on the medium placement unit with the heating unit by using the amount of liquid discharged by the discharging unit to the medium as the condition, and thus the recording can be achieved in consideration of both the improvement in fixing characteristic of the liquid to the medium and the reduction in running cost of the device.

In a sixth aspect, the control unit uses at least one of a temperature and a humidity in an environment in which the device is installed as the condition in the first to fifth aspects.

According to the present aspect, the control unit more appropriately heats the medium placed on the medium placement unit with the heating unit by using at least one of the temperature and the humidity in the environment in which the device is installed as the condition, and thus the recording can be achieved in consideration of both the improvement in fixing characteristic of the liquid to the medium and the reduction in running cost of the device.

In a seventh aspect, the control unit controls an overlapping heating unit and a neighboring heating unit such that the overlapping heating unit and the neighboring heating unit are in an identical heating state, the overlapping heating unit being a heating unit of the plurality of heating units that overlaps a high concentration region of the medium where a largest amount of the liquid is discharged in the first axial direction and the second axial direction, the overlapping heating unit overlapping the high concentration region over a largest range among the plurality of heating units, the neighboring heating unit being a heating unit of the plurality of heating units that is adjacent to the overlapping heating unit in one of the first axial direction and the second axial direction in the second aspect.

The "identical" heating state includes not only the case where the heating units have exactly the same temperature, but also the case where the heating units have slightly different temperatures that can be regarded as the same temperature.

According to the present aspect, for example, in the case where a part of the overlapping heating unit does not overlap the high concentration region in the first axial direction and the second axial direction, the high concentration region can be heated using a neighboring heating unit adjacent to the overlapping heating unit. Thus, the fixing characteristic of the liquid in the high concentration region can be improved.

A recording method according to an eighth aspect is a method for a recording device, the recording device includes a medium placement unit on which a medium is fixedly placed, a discharging unit configured to discharge liquid to the medium, a moving unit configured to move the discharging unit in a first axial direction with respect to the medium placement unit, and one or more heating units provided at the medium placement unit, the one or more heating units being configured to heat the medium placed on the medium placement unit, the method comprising: setting a heating state of the one or more heating units based on a condition under which recording performed on the medium, heating the medium by the one or more heating units in a heating state set in the second step, and discharging the liquid from the discharging unit to the medium heated by the one or more heating units in the heating state.

According to the present aspect, a heating state of the one or more heating units is set on a basis of a condition under which recording to the medium is performed, and the medium is heated by the one or more heating units in that heating state, and, the liquid is discharged from the discharging unit to the heated medium. Thus, the running cost of the device can be reduced.

First Embodiment

A first embodiment of a recording device is described below with reference to the drawings. In the X-Y-Z coordinate system illustrated in each of the drawings, an X-axis direction represents a device width direction, a Y-axis direction represents a device depth direction, and a Z-axis direction represents a device height direction.

Figure 2:
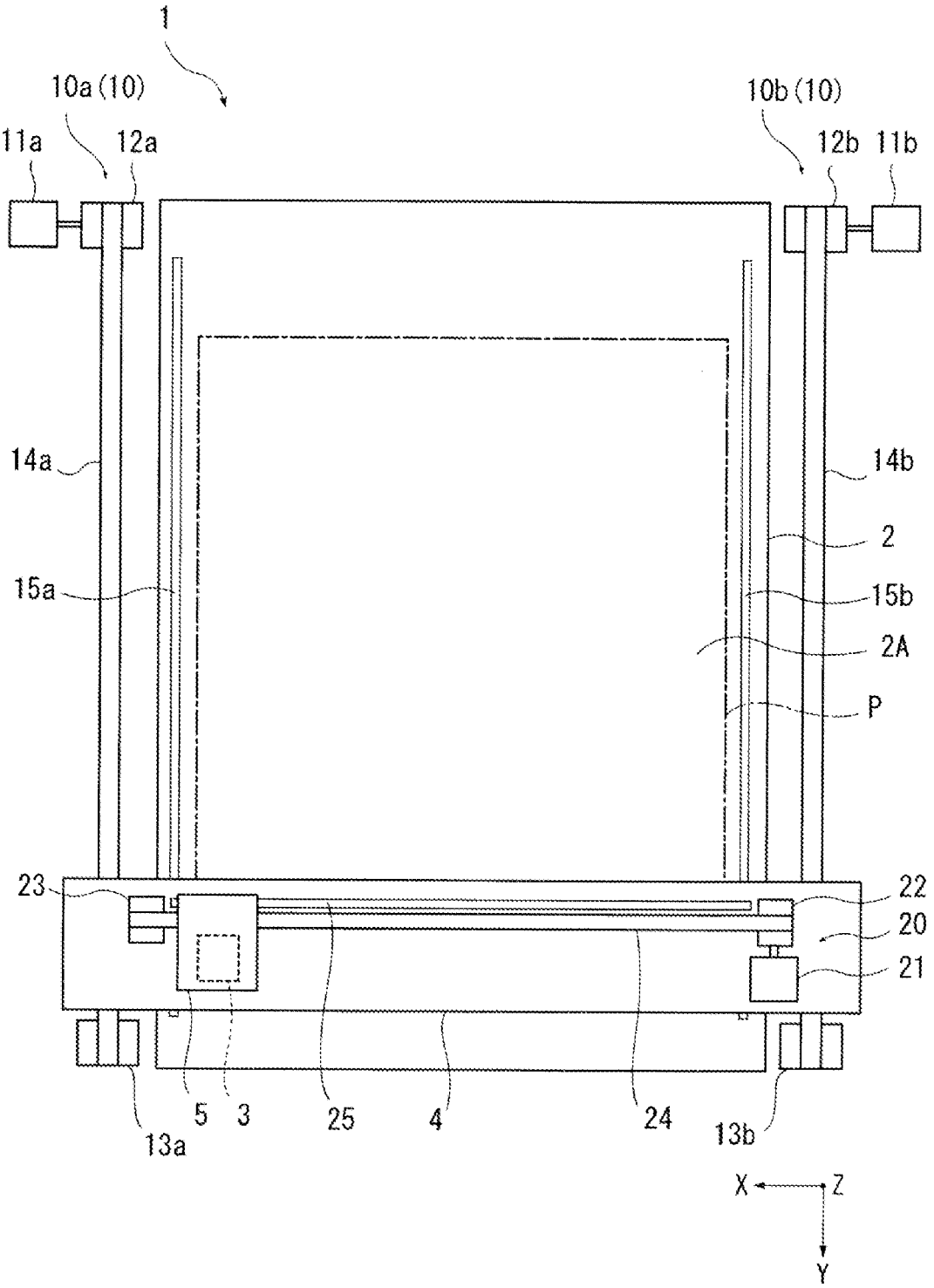
FIG. 2 is a schematic plan view illustrating the recording device according to the first exemplary embodiment.

FIG. 1 and FIG. 2 are schematic plan views of a recording device 1 according to this embodiment. The recording device 1 is an ink jet printer capable of forming an image on a medium P by discharging liquid ink from a recording head 3 described later.

As illustrated in FIG. 1 and FIG. 2, the recording device 1 includes a medium placement unit 2 on which a medium P is fixedly placed, a recording head 3 serving as a discharging unit that discharges ink toward the medium P placed on the medium placement unit 2, and a gantry 4 serving as a moving unit that includes the recording head 3 and is movable along the Y-axis direction as a first axial direction with respect to the medium placement unit 2. Hereinafter, the first axial direction is referred to as a first axial direction Y.

Note that FIG. 1 illustrates a state where the gantry 4 is located at a home position at one end position in the first axial direction Y, and FIG. 2 illustrates a state where the gantry 4 is located at an end opposite to the home position.

While the gantry 4 moves with respect to the medium placement unit 2 whose position is fixed in this embodiment, the medium placement unit 2 may move with respect to the gantry 4 whose position is fixed. In other words, it suffices that the gantry 4 relatively moves in the Y-axis direction with respect to the medium placement unit 2.

The medium placement unit 2 includes a placement surface 2A on which the medium P is fixedly placed. The recording device 1 is a so-called flatbed recording device that performs recording on the medium P placed on the medium placement unit 2 in the state where the position of the medium P is fixed. The medium P is suctioned and held on the placement surface 2A by a suction mechanism (not illustrated) including a plurality of suction holes formed in the medium placement unit 2 and a negative pressure chamber that communicates with the plurality of suction holes and generates a negative pressure. In this manner, the medium P is placed on the medium placement unit 2 and the position of the medium P is fixed. Note that the suction mechanism is not limitative, and the medium P may be placed on the medium placement unit 2 and the position of the medium P may be fixed by a pressing mechanism (not illustrated) that presses the medium P against the placement surface 2A.

The medium P may be manually set on the medium placement unit 2 by the user, and it is also possible to adopt a configuration in which a medium transporting mechanism (not illustrated) capable of feeding the medium P of a roll form is provided so as to feed the medium P to the placement surface 2A before starting the recording, for example.

Ink-jet recording paper such as plain paper, pure paper, and glossy paper may be used as the medium P. In addition, for example, a plastic film provided with no surface treatment for ink-jet printing, i.e., a plastic film provided with no ink absorption layer, a material including a plastic-coated base material such as paper, and a material on which a plastic film is bonded may be used as the medium P. The examples of the plastic include, but not limited to, polyvinyl chloride, polyethylene terephthalate, polycarbonate, polystyrene, polyurethane, polyethylene, and polypropylene.

In addition, a textile printing material such as a fabric may be appropriately used as the medium P. The examples of the fabric include natural fibers such as cotton, silk and wool, chemical fibers such as nylon, and woven cloths, knit fabrics, and non-woven cloths of composite fibers of the natural fibers and chemical fibers.

For example, a dye ink or a pigment ink may be used as the ink. In addition, an UV (ultraviolet) ink that cures under ultraviolet irradiation may be used. In the case where an UV ink is used, the recording head 3 is provided with an UV light source (not illustrated) that fixes the ink on the medium P by curing the ink.

The recording head 3 is provided at a position opposite to a placement region of the medium P in the medium placement unit 2, and is capable of discharging ink toward the placement region. The recording device 1 according to this embodiment is capable of printing an image by ejecting ink from the recording head 3 to the transported medium P by moving the gantry 4 in the first axial direction Y while moving the carriage 5 back and forth in the X axial direction, which is a second axial direction intersecting the first axial direction Y. Note that the second axial direction is referred to as a second axial direction X.

FIG. 1 illustrates a state where the carriage 5 is located at a home position, which is one end position in the second axial direction X, and FIG. 2 illustrates a state where the carriage 5 is located at the end opposite to the home position.

The recording device 1 includes a first movement mechanism 10 that moves the gantry 4 in the first axial direction Y, and a second movement mechanism 20 that moves the carriage 5 in the second axial direction X. The configurations of the first movement mechanism 10 and the second movement mechanism 20 are described in detail later.

Figure 3:
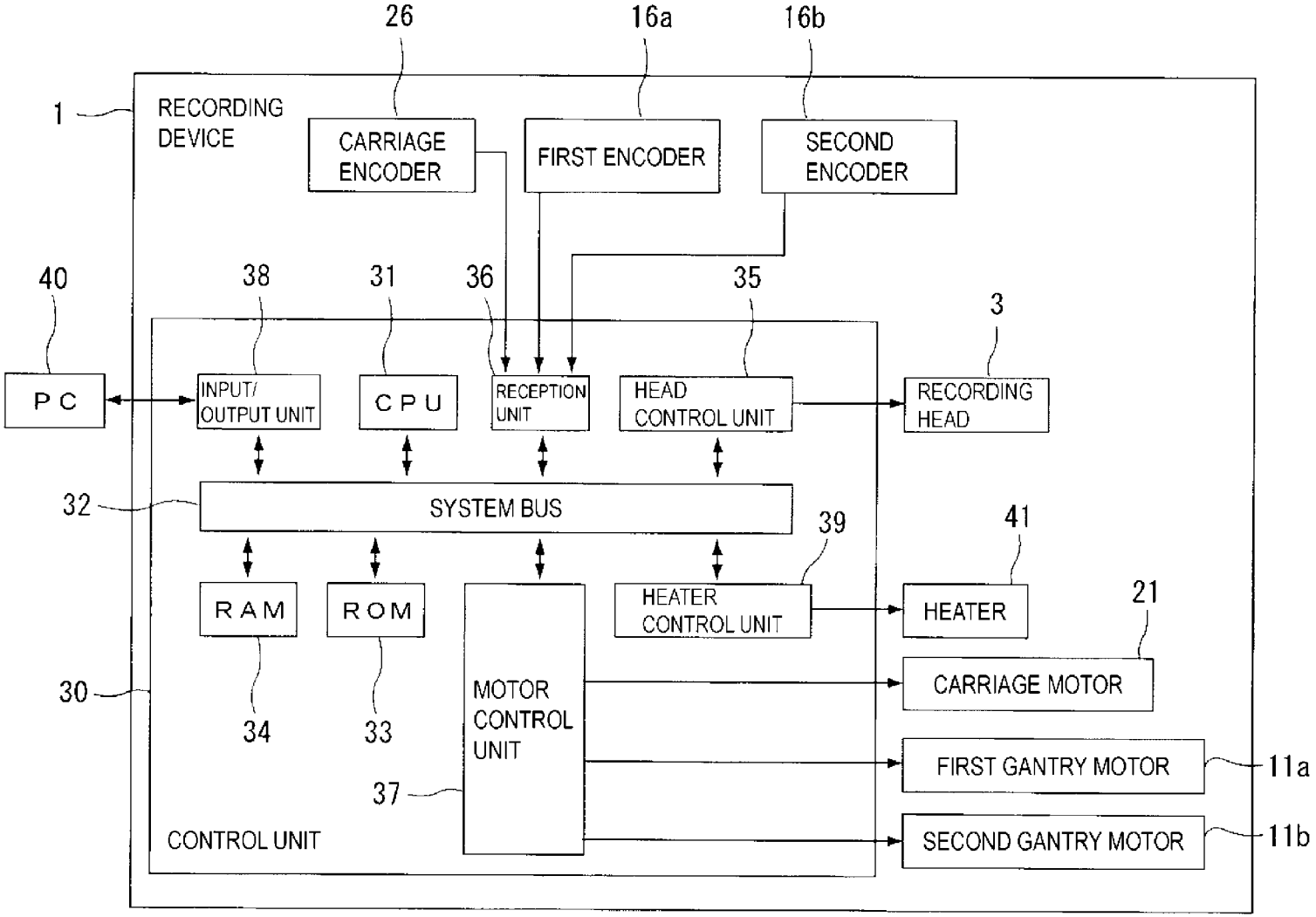
FIG. 3 is a block diagram illustrating the recording device according to the first exemplary embodiment.

Further, as illustrated in FIG. 3, the recording device 1 includes a heater 41 (see also FIG. 4) provided at the medium placement unit 2 and serving as a heating unit capable of heating the medium P placed on the medium placement unit 2, and a control unit 30 including a heater control unit 39 that controls the heater 41.

The recording device 1 according to this embodiment has a feature in which the control unit 30 (the heater control unit 39) controls heating of the medium P with the heater 41 in accordance with the condition.

For example, when ink is discharged to the medium P for recording in the case where the temperature of the medium P before recording is low, the ink adhered to the medium P may not settle on medium P, thus leading to a poor fixing characteristic. In addition, when the ink discharge amount (hereinafter referred to as the liquid discharge amount) to the medium P is large, the fixing characteristic tends to be poor. By heating the medium P with the heater 41, the degradation of the fixing characteristic of the ink to the medium P can be suppressed.

Examples of the condition used when the control unit 30 controls heating of the medium P with the heater 41 include the type of the medium P such as the paper type, size, thickness, basis weight, and rigidity of the medium P, the liquid discharge amount to the medium P, and the temperature and humidity of the environment where the recording device 1 is installed.

When the control unit 30 controls heating of the medium P with the heater 41 in accordance with the above-mentioned condition, the medium P placed on the medium placement unit 2 can be appropriately heated with the heater 41, and the fixing characteristic of the ink to the medium P can be improved. Detailed examples of the control of heating the medium P with the heater 41 by using the above-mentioned condition are described later. In addition, while the running cost of the device increases when the heating of the medium P with the heater 41 is performed, the recording can be achieved in consideration of the reduction in running cost of the device by controlling the heating of the medium P with the heater 41 by using the condition.

As an example, the heater 41 may use a Peltier element as a heating member. In addition, the heating may be performed by an induction heating method in which the heat is generated by the action of the magnetic field that is generated by passing a current through an induction coil. In addition, a light source such as a halogen lamp may be used as a heat source.

Figure 4:
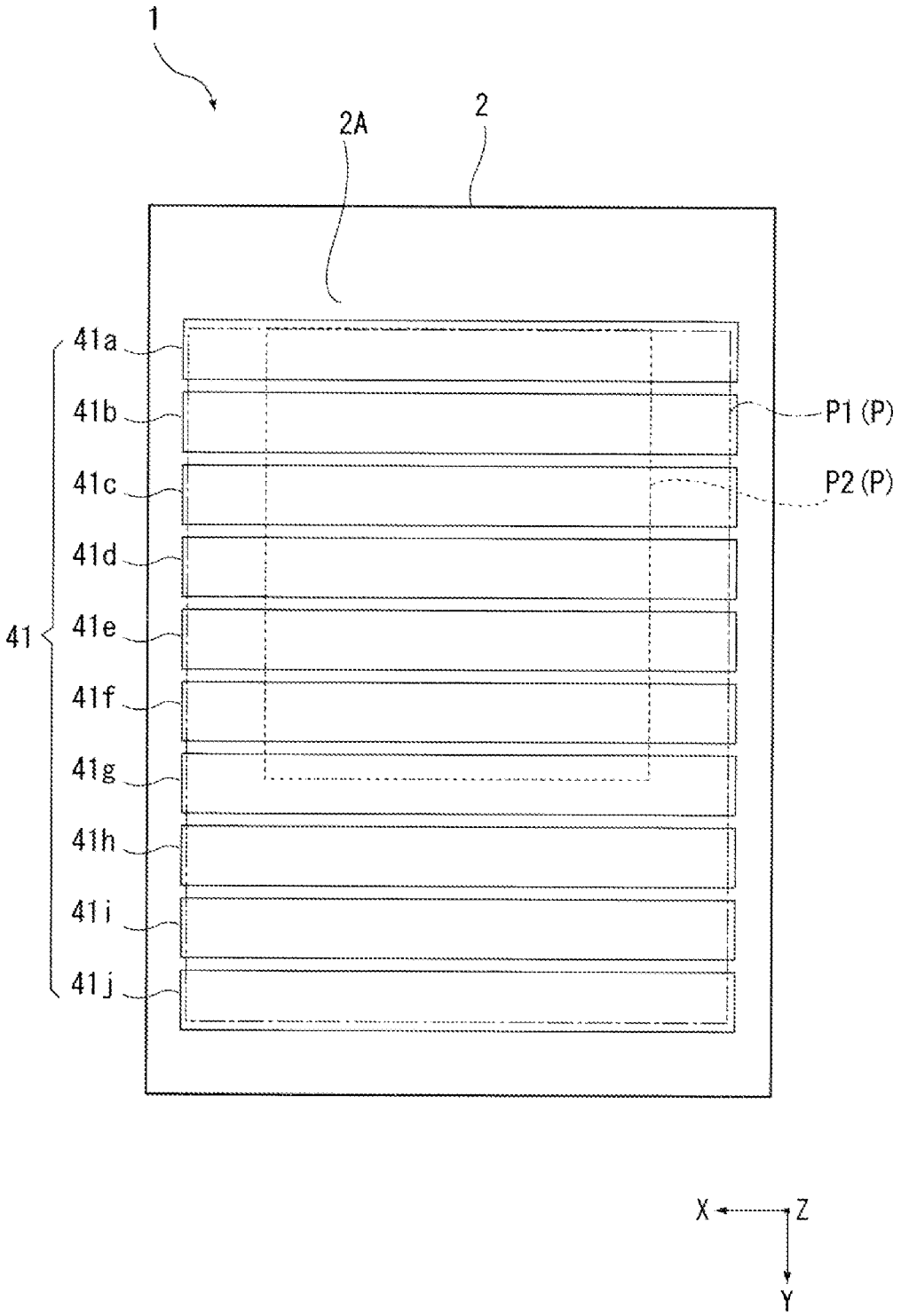
FIG. 4 is a schematic plan view illustrating a medium placement unit of the recording device according to the first exemplary embodiment.

In this embodiment, a plurality of the heaters 41 are provided side by side in the first axial direction Y as illustrated in FIG. 4. As an example, the heaters 41 are provided in ten lines of heaters 41*a*, 41*b*, 41*c*, 41*d*, 41*e*, 41*f*, 41*g*, 41*h*, 41*i* and 41*j*. The control unit 30 is capable of changing the heaters 41*a*, 41*b*, 41*c*, 41*d*, 41*e*, 41*f*, 41*g*, 41*h*, 41*i* and 41*j* in the first axial direction Y. In other words, the plurality of heaters 41 can be individually controlled.

The plurality of heaters 41 may be provided side by side in the second axial direction X. In addition, the plurality of heaters 41 may be provided side by side in both the first axial direction Y and the second axial direction X. The plurality of heaters 41 may be changed in one or both of the first axial direction Y and the second axial direction X.

Control of Heater by Control Unit

The control of heating of the medium P with the heater 41 that is performed by the control unit 30 by using the condition is described below.

Control According to Size of Medium

The control unit 30 is configured to be capable of heating the medium P by selecting, from among the plurality of heaters 41 illustrated in FIG. 4, the heater 41 overlapping the medium P placed on the medium placement unit 2 in the first axial direction Y and the second axial direction X. For example, in the case where the medium P used for the recording is a medium P1 having the size indicated by the dot-dash line in FIG. 4, the control unit 30 heats the medium P1 with all the ten heaters, 41*a* to 41*j*. Note that the medium P1 is the medium P having a maximum size that can be recorded in the recording device 1.

On the other hand, in the case where the medium P used for the recording is a medium P2 having a size indicated by the dotted line in FIG. 4, the control unit 30 selects the heaters 41*a* to 41*g* having a portion overlapping the medium P2 in the first axial direction Y and the second axial direction X to perform the heating, and turns off the heaters 41*h* to 41*j*.

By turning off the heaters 41 that do not overlap the medium P2 in the plurality of heaters 41 in the above-mentioned manner, the power consumption can be saved and the running cost of the recording device 1 can be reduced.

Note that the control unit 30 can acquire the size of the medium P from driver information input by the user from an input unit (not illustrated) provided at the recording device 1, or from driver information from a computer (a PC 40 illustrated in FIG. 3) coupled with the recording device 1, and the like.

Control According to Type of Medium

When the mediums after recording are heated in the same heating state, the ink fixing characteristic to the medium may not be properly obtained due to the difference in the type of medium.

The control unit 30 can perform heating of the medium P with the heater 41 by using the type of the medium P as a condition. Examples of the type of the medium P include the material, thickness, and basis weight of the medium P.

The control unit 30 can adjust the heating of the medium P with the heater 41 on the basis of a control table representing the relationship between the type of the medium P and the temperature of the heater 41 as shown in Table 1, for example.

TABLE 1

| Type of medium | Heater temperature |
|---|---|
| Thin paper | First temperature |
| Medium paper | Second temperature |
| Thick paper | Third temperature |

In Table 1, the first temperature, the second temperature, and the third temperature have a relationship of the first temperature<the second temperature<the third temperature. Examples of the type of the medium P include thin paper, medium paper, and thick paper, which are classified by the difference in thickness.

The ease of the transmission of the heat of the heater 41 to the medium P increases as the thickness of the medium P decreases, and decreases as the thickness of the medium P increases. As such, when thick paper is heated in a heating state suitable for thin paper, the surface of the thick paper is not warmed to a sufficient temperature, and an ink fixing failure may occur.

In accordance with the control table shown in Table 1, the control unit 30 reduces the temperature of the heater 41 as the thickness of the medium P decreases, and increases the temperature of the heater 41 as the thickness of the medium P increases. Thus, the risk of the ink fixing failure on the thick medium P can be reduced. In addition, since the temperature of the heater 41 is set to a low temperature when the thickness of the medium P is small, the running cost of the recording device 1 can be reduced.

As described above, when the control unit 30 uses the type of the medium P as a condition, the medium P placed on the medium placement unit 2 can be more appropriately heated with the heater 41, and thus the recording can be achieved in consideration of both the improvement in fixing characteristic of the ink to the medium P and the reduction in running cost of the device.

Note that in the control table shown in Table 1, the first temperature, which is the lowest heating temperature, also includes a state where the heater 41 is not heated, i.e., a case where the heating of the medium P with the heater 41 is set to off.

Control According to Liquid Discharge Amount

When the mediums after recording are heated in the same heating state, the ink fixing characteristic to the medium may not be properly obtained due to the difference in the recording content.

The control unit 30 can heat the medium P with the heater 41 by using the ink discharge amount, which is the liquid discharge amount from the recording head 3 to the medium P.

As described above, when the ink discharge amount to the medium P per unit area is large, the ink adhered to the medium P may not readily dry on the medium P, thus leading to a poor fixing characteristic. For example, in the case where the ink is solvent ink, the solvent cannot sufficiently evaporate, and the scratch resistance is reduced. In the case where the ink is a latex ink, the glass transition temperature cannot be reached, and the scratch resistance is reduced. Accordingly, by controlling the heating of the medium P with the heater 41 in accordance with the discharge amount of the ink from the recording head 3 to the medium P, the degradation of the fixing characteristic of the ink to the medium P can be appropriately suppressed.

The control unit 30 can adjust the heating of the medium P with the heater 41 on the basis of a control table representing the relationship between the ink discharge amount to the medium P and the temperature of the heater 41 as shown in Table 2, for example.

Note that, in the following description, the recording concentration (%) is used as an example of a value corresponding to the ink discharge amount to the medium P. The recording concentration (%) is a value that increases or decreases in accordance with the ink discharge amount to the medium P, and is a percentage of the total ink discharge amount (g) with respect to the maximum ink-applicable amount (g) for a recordable region of a single medium P. That is, recording concentration (%)=total ink discharge amount (g)/maximum ink-applicable amount (g) per medium P×100 holds. The maximum ink-applicable amount (g) for the recordable region of a single medium P can be determined from the maximum ink-applicable amount per unit area of the medium P. The maximum ink-applicable amount (g) per unit area of the medium P can be set in accordance with the type of the ink and the type of the medium P classified by the difference in material and thickness.

In addition, the recording concentration (%) is not limited to this. For example, the recording concentration (%) may be the percentage of the area of the region where the ink is discharged with respect to the area of a single medium P.

Note that the maximum ink-applicable amount (g) may be a maximum discharge amount of the ink that can be discharged by the recording head 3 in a predetermined period. That is, it is possible to express the ink discharge amount by which the image is recorded to the recordable region with respect to the maximum ink-applicable amount (g) that can be discharged by the recording head 3 per unit time in the case of recording concentration (%)=total ink discharge amount (g)/maximum ink–applicable amount (g) per medium P×100.

TABLE 2

| Recording temperature (%) | Heater temperature |
|---|---|
| Lower than 20 (Low concentration region) | First temperature |
| 20 or higher and lower than 60 (Medium concentration region) | Second temperature |
| 60 or higher (High concentration region) | Third temperature |

In Table 2, the first temperature, the second temperature, and the third temperature have a relationship of the first temperature<the second temperature<the third temperature.

As described above, when the recording concentration on the medium P increases, the ink is does not readily dry on the medium P, and the fixing characteristic of the ink to the medium P tends to become poor. The fixing characteristic of the ink to the medium P is improved when the surface temperature of the medium P is increased. In accordance with the control table shown in Table 2, the control unit 30 reduces the temperature of the heater 41 as the recording concentration decreases, and increases the temperature of the heater 41 as the recording concentration increases. It is thus possible to reduce the risk of the ink fixing failure on the medium P when the recording concentration is high, i.e., when the ink discharge amount to the medium P is large. In addition, when the recording concentration is low, the temperature of the heater 41 is set to a low temperature, and thus the running cost of the recording device 1 can be reduced. In other words, the recording can be achieved in consideration of both the improvement in fixing characteristic of the ink to the medium P and the reduction in running cost of the device.

Note that, in the control table shown in Table 2, the temperature of the heater 41 is set in three stages having a relationship of the first temperature<the second temperature<the third temperature as an example. Naturally, the temperature may be controlled in more stages. In addition, when the ink discharge amount to the medium P is small, the heating of the medium P with the heater 41 may be set to off.

In addition, as illustrated in FIG. 4, in the recording device 1 according to this embodiment including a plurality of heaters 41, the following control may be performed.

Figure 5:
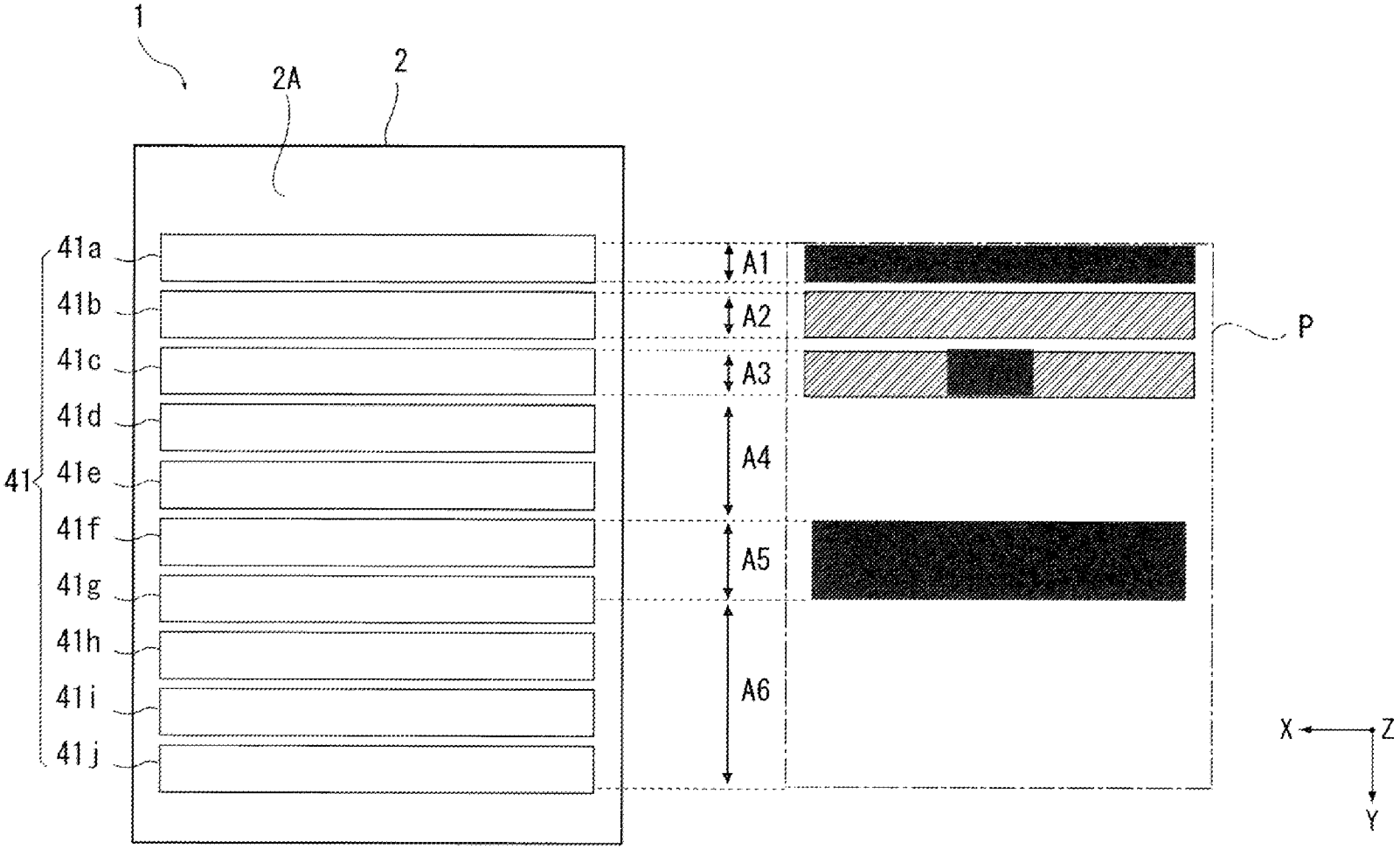
FIG. 5 is a diagram illustrating heating of a medium by a heater provided at the medium placement unit.

For example, as illustrated in the right part in FIG. 5, in the case where the image data for the medium P includes a black solid portion, which is a high concentration region where a largest amount of ink is discharged to the medium P, a hatched portion, which is a medium concentration region whose recording concentration is lower than that of the high concentration region, and a white portion, which is a low concentration region whose concentration is lower than that of the medium concentration region, the temperatures of the plurality of heaters 41 can be changed in accordance with the portions having different recording concentrations.

In FIG. 5, a recording range A1 in the first axial direction Y is a high concentration region. Accordingly, the heater 41*a* overlapping the recording range A1 in the first axial direction Y performs heating at the third temperature higher than the first temperature and the second temperature.

In addition, a recording range A2 in the first axial direction Y is the medium concentration region. Accordingly, the heater 41*b* overlapping the recording range A2 in the first axial direction Y performs heating at the second temperature higher than the first temperature and lower than the third temperature.

In addition, in a recording range A3 in the first axial direction Y, the medium concentration region and the high concentration region are mixed in the second axial direction X. In such a case, the heater 41*c* overlapping the recording range A3 in the first axial direction Y performs heating at the third temperature corresponding to the high concentration region. Thus, the ink fixing characteristic in the high concentration region in the recording range A3 can be improved.

In addition, a recording range A4 in the first axial direction Y is the low concentration region. Thus, the heater 41*d* and the heater 41*e* overlapping the recording range A4 in the first axial direction Y perform heating at the first temperature, which is the lowest temperature. The first temperature may be set as a heating temperature of zero degree, i.e., no heating (with the heater 41*d* and the heater 41*e* set to off).

In addition, the recording range A5 in the first axial direction Y is the high concentration region. Accordingly, the heater 41*f* and the heater 41*g* overlapping the recording range A5 in the first axial direction Y perform heating at the third temperature, which is the highest temperature. While the heater 41*g* also overlaps a recording range A6, which is the low concentration region, the heater 41*g* is set to the third temperature, which corresponds to the high concentration region. Thus, the ink fixing characteristic in the high concentration region in the recording range A5 can be improved.

In addition, the recording range A6 in the first axial direction Y is the low concentration region as described above. Accordingly, the heater 41*h*, the heater 41*i*, and the heater 41*j* overlapping the recording range A6 in the first axial direction Y are set to the lowest first temperature.

In the above-mentioned manner, by setting the plurality of heaters 41 to the heating states according to the recording concentrations of the corresponding recording ranges, the effect of the improvement in ink fixing characteristic to the medium P and the reduction in running cost of the device can be further efficiently achieved.

Further, the control unit 30 may perform the following control.

Specifically, a control is performed such that, among the plurality of heaters 41, the heater 41*a* as an overlapping heating unit overlapping a high concentration region (e.g., the recording range A1) where a largest amount of ink is discharged to the medium P in the first axial direction Y and the second axial direction X, and the heater 41*b* as a neighboring heating unit adjacent to the heater 41*a* in the first axial direction Y are set to the same heating state.

In other words, while the range where the heater 41*b* overlaps in the first axial direction Y and the second axial direction X is the recording range A2, which is the medium concentration region, the heater 41*b* is controlled at the heating state (third temperature) identical to that of the high concentration region.

Thus, the ink fixing characteristic in the recording range A1, which is the high concentration region, can be further improved.

Note that for the recording range A3 including the high concentration region, the heater 41*c* as an overlapping heating unit overlapping the recording range A3 over the largest range, and the heater 41*b* and the heater 41*d*, which are adjacent heating units adjacent to the heater 41*c* in the first axial direction Y may be controlled at the third temperature as the same heating state.

In addition, for the recording range A5, which is the high concentration region, the heater 41*f* as an overlapping heating unit overlapping the recording range A5 over the largest range, and the heater 41*e* and the heater 41*g*, which are adjacent heating units adjacent to the heater 41*f* in the first axial direction Y may be controlled at the third temperature as the same heating state. Thus, the ink fixing characteristic can be further improved even in the case where the recording range in the first axial direction Y does not completely overlap the heating range of the single heater 41 in the first axial direction Y.

While the recording device 1 can heat the placement region of the medium P in a uniform heating state by setting all the heaters 41 to the same heating state, the medium can be more appropriately heated and thus the fixing characteristic of the liquid to the medium can be improved by individually changing the heating state of the heaters 41*a*, 41*b*, 41*c*, 41*d*, 41*e*, 41*f*, 41*g*, 41*h*, 41*i*, and 41*j* on the medium P on the basis of the image data to be recorded to the medium P. Naturally, it is possible to adopt a configuration in which the medium P is heated with a single heater without disposing the plurality of heaters 41.

Control According to Environmental Temperature

When the mediums after recording are heated in the same heating state, the ink fixing characteristic to the medium may not be properly obtained due to differences in environmental temperature, environmental humidity, and the like.

The control unit 30 can heat the medium P with the heater 41 by using at least one of the temperature and the humidity in the installation environment of the device as a condition.

The control unit 30 can adjust the heating of the medium P with the heater 41 on the basis of a control table representing the relationship between the temperature in the installation environment of the device and the temperature of the heater 41 as shown in Table 3, for example. Note that the plurality of heaters 41 can be uniformly set to one heating state.

TABLE 3

| Temperature of installation environment of device (° C.) | Heater temperature |
|---|---|
| Lower than 10 | Third temperature |
| 10 or higher and lower than 18 | Second temperature |
| 18 or higher and lower than 25 | Second temperature |
| 25 or higher and lower than 35 | First temperature |
| 35 or higher | First temperature |

In Table 3, the first temperature, the second temperature, and the third temperature have a relationship of the first temperature<the second temperature<the third temperature.

As described above, when the temperature of the medium P before recording is low, the fixing characteristic of the ink to the medium P may be poor when the ink is discharged to the medium P for recording. In accordance with the control table shown in Table 3, the control unit 30 heats the temperature of the heater 41 such that the temperature of the heater 41 increases as the temperature of the installation environment of the recording device 1 decreases, and the temperature of the heater 41 decreases as the temperature of the installation environment of the recording device 1 increases.

It is thus possible to reduce the risk of the ink fixing failure in case where the temperature of the medium P before recording may be low because of a low temperature of the installation environment of the recording device 1. In addition, the temperature of the heater 41 is set to a low temperature in the case where the temperature of the installation environment of the recording device 1 is high, and thus the running cost of the recording device 1 can be reduced.

As the control table, it is possible to use a table in which the heater temperature is set in accordance with the humidity of the installation environment of the recording device 1, and a table in which the temperature of the heater is set in accordance with the temperature and the humidity of the installation environment.

Note that, in the control table shown in Table 3, the temperature of the heater 41 is set in three stages having a relationship of the first temperature<the second temperature<the third temperature as an example. Naturally, the temperature may be controlled in more stages. The first temperature, which is the lowest heating temperature, also includes a state where the heater 41 is not heated, i.e., a case where the heating of the medium P with the heater 41 is set to off.

In the recording device 1, a temperature detection unit (not illustrated) that detects the temperature of the environment in which the recording device 1 is installed may be provided. In addition, a humidity detection unit (not illustrated) that detects the humidity of the environment in which the recording device 1 is installed may be provided.

In addition, it is possible to adopt a configuration in which the temperature information or the humidity information is acquired from driver information input by the user from an input unit (not illustrated) provided at the recording device 1, or from driver information from a computer (the PC 40 illustrated in FIG. 3) coupled with the recording device 1, and the like.

Figure 6:
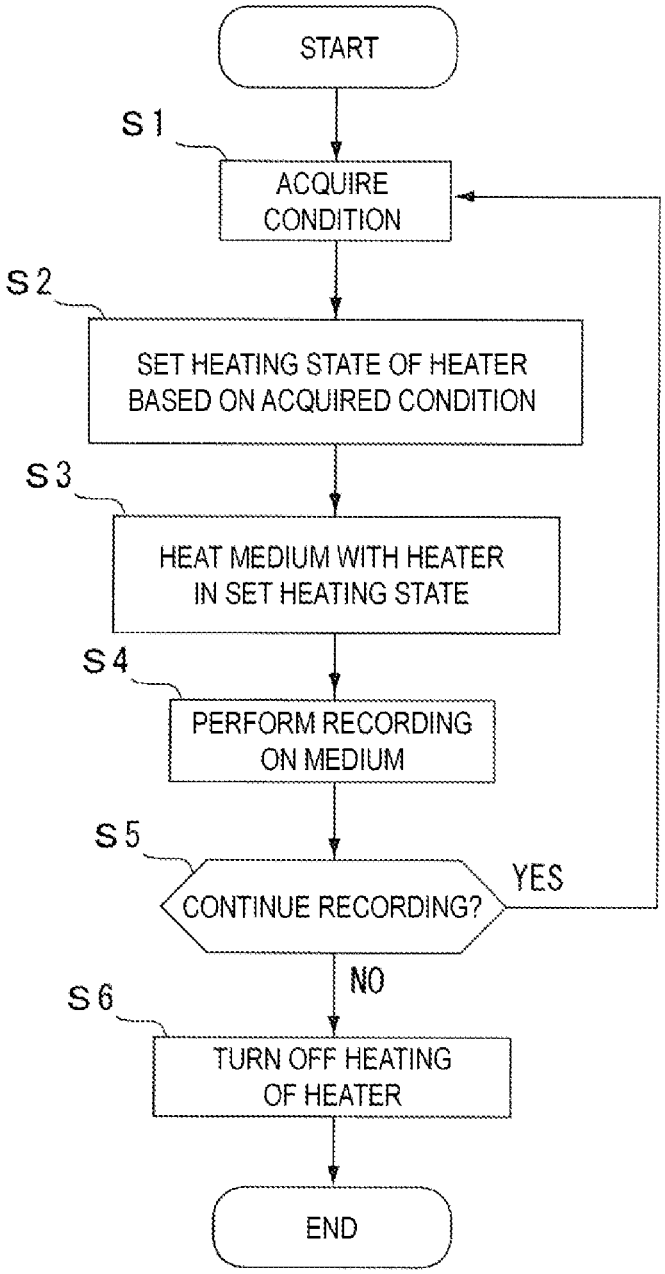
FIG. 6 is a flowchart illustrating control by a control unit when recording on a medium is performed in the recording device.

A recording method in the recording device 1 is described below with reference to the flowchart illustrated in FIG. 6.

First, the control unit 30 (FIG. 3) acquires a condition under which recording to the medium P is performed (step S1). Examples of the condition under which recording to the medium P is performed include recording data to be recorded, information about the medium P such as the type and the size of the medium P input by the user, the temperature and/or the humidity detected by a temperature detection unit (not illustrated) or a humidity detection unit (not illustrated) provided at the recording device 1, a temperature condition or a humidity condition input by the user, and the ink discharge amount (liquid discharge amount) to the medium P that is calculated from the recording data.

Next, the heating state of the heater 41 is set based on the condition acquired at step S1 (step S2). The setting of the heating state on the basis of the condition is performed by the control unit 30 in accordance with the control table described above.

Next, the medium P is heated with the heater 41 in the heating state set at step S2 (step S3). Then, ink is discharged from the recording head 3 to the medium P heated at step S3 to perform the recording (step S4). Upon completion of the recording, whether the recording is continued to the next medium is determined (step S5). When the next recording is performed, i.e., YES at step S5, then the process is returned to step S1 to perform the next recording. When the next recording is not performed, i.e., NO at step S5, the heater 41 is turned off (step S6) and the recording is terminated.

In brief, the recording method in the recording device 1 includes a first step (step S2) of setting the heating state of the heater 41 on the basis of a condition under which recording to the medium P is performed, a second step of heating the medium P with the heater 41 in the heating state set at the first step (step S3), and a third step (step S4) of discharging ink from the recording head 3 to the medium P heated at the second step (step S4).

By setting the heating state of the heater 41 on the basis of the condition under which recording to the medium P is performed so as to heat the medium P in that heating state with the heater 41 and to discharge ink from the recording head 3 to the heated medium P, the recording can be achieved in consideration of both the improvement in fixing characteristic of the liquid to the medium and the reduction in running cost of the device.

Movement Mechanism of Gantry and Carriage

As illustrated in FIG. 1 and FIG. 2, the recording device 1 includes the first movement mechanism 10 that moves the gantry 4 in the first axial direction Y and the second movement mechanism 20 that moves the carriage 5 in the second axial direction X. The first movement mechanism 10 and the second movement mechanism 20 are described below in this order with reference to FIG. 1 and FIG. 2.

The first movement mechanism 10 includes a first movement mechanism 10*a* and a first movement mechanism 10*b*, and, in front view of FIG. 1 and FIG. 2, the first movement mechanism 10*a* and the first movement mechanism 10*b* are provided on both sides of the medium placement unit 2 in the second axial direction X.

The first movement mechanism 10*a* includes a first motor 11*a* serving as a drive source, a first drive roller 12*a* that is driven into rotation by the first motor 11*a*, a first driven roller 13*a* that rotates along with the rotation of the first drive roller 12*a*, a first endless belt 14*a* that is looped around the first drive roller 12*a* and the first driven roller 13*a*, and a first scale 15*a* that detects the movement amount of the gantry 4.

Although the detailed description of the first movement mechanism 10*b* is omitted, the first movement mechanism 10*b* includes a second motor 11*b*, a second drive roller 12*b*, a second driven roller 13*b*, a second belt 14*b*, and a second scale 15*b* corresponding to the first motor 11*a*, the first drive roller 12*a*, the first driven roller 13*a*, the first belt 14*a*, and the first scale 15*a* of the first movement mechanism 10*a*, and the first movement mechanism 10*b* has a configuration similar to that of the first movement mechanism 10*a*.

The gantry 4 is attached to the first belt 14*a* and the second belt 14*b*, and the power of the first motor 11*a* and the second motor 11*b* is transmitted to the gantry 4 through the first belt 14*a* and the second belt 14*b* so as to move the gantry 4 together with the first belt 14*a* and the second belt 14*b*.

The gantry 4 is provided with a first encoder 16*a* (FIG. 3) and a second encoder 16*b* (FIG. 3) that read the respective scales of the first scale 15*a* and the second scale 15*b*. Thus, the location information of the gantry 4 and the movement rate of the gantry 4 are calculated from the scales read by the encoders, and the movement amount of the gantry 4 is calculated.

The second movement mechanism 20 includes a carriage motor 21 serving as a drive source, a drive roller 22 that is driven into rotation by the carriage motor 21, and a driven roller 23 that is driven into rotation by the drive roller 22, an endless belt 24 looped around the drive roller 22 and the driven roller 23, and a carriage scale 25 that detects the movement amount of the carriage 5.

The carriage 5 is attached to the belt 24, and the power of the carriage motor 21 is transmitted to the carriage 5 through the belt 24 so as to move the carriage 5 together with the belt 24.

The carriage 5 is provided with a carriage encoder 26 (FIG. 3) that reads the scale of the carriage scale 25. Thus, the positional information of the carriage 5 and the movement rate of the carriage 5 are calculated from the scales read by the carriage encoder 26, and the movement amount of the carriage 5 is calculated.

Electrical Configuration

Next, an electrical configuration of the recording device 1 according to this embodiment is described with reference to FIG. 3.

The recording device 1 is provided with the control unit 30 that performs various controls in the recording device 1 including the heater 41. The control unit 30 is provided with a CPU 31 that manages the control of the entire recording device 1. Through a system bus 32, the CPU 31 is coupled with a ROM 33 that stores various control programs that are implemented by the CPU 31, and a RAM 34 that can temporarily store data.

In addition, through the system bus 32, the CPU 31 is coupled with a head control unit 35 for performing the ink discharging operation from the recording head 3.

In addition, through the system bus 32, the CPU 31 is coupled with a reception unit 36 that receives scale information read by the first encoder 16*a*, the second encoder 16*b*, and the carriage encoder 26, a motor control unit 37 for driving the first motor 11*a*, the second motor 11*b*, and the carriage motor 21, and the heater control unit 39 that controls the heating of the medium with the heater 41.

Further, the CPU 31 is coupled with an input/output unit 38 through the system bus 14, and the input/output unit 38 can be coupled with the PC 40 for transmitting and/or receiving signals and data such as recording data.

While the recording head 3 is of a serial type that performs recording while moving in the second axial direction X in this embodiment, the recording head 3 may be of a line head type capable of performing recording within a medium maximum width range in the state where the position of the recording head 3 in the second axial direction X is fixed. In other words, a configuration may be adopted in which a line head serving as a discharging unit is provided at the gantry 4, and the recording is performed while moving the gantry 4 in the first axial direction Y.

Note that the present disclosure is not intended to be limited to the aforementioned embodiments, and various modifications may be made within the scope of the appended claims. The scope of the present disclosure also encompasses such modifications.

What is claimed is:

1. A recording device comprising:

a medium placement unit on which a medium is fixedly placed;

a discharging unit configured to discharge liquid toward the medium placed on the medium placement unit;

a moving unit including the discharging unit, the moving unit being configured to move relative to the medium placement unit along a first axial direction, the discharging unit being configured to move in relation to the moving unit in a second axial direction that intersects the first axial direction;

one or more heating units provided at the medium placement unit and configured to heat the medium placed on the medium placement unit; and a control unit configured to control the one or more heating units, wherein the control unit controls heating of the medium by the one or more heating units in accordance with a condition.

2. The recording device according to claim 1, wherein the plurality of heating units are provided side by side in at least one of the first axial direction and the second axial direction that intersects the first axial direction; and the control unit is configured to change a heating state of the plurality of heating units in at least one of the first axial direction and the second axial direction.

3. The recording device according to claim 2, wherein the control unit is configured to select, from among the plurality of heating units, at least one heating unit that overlaps, in the first axial direction and the second axial direction, the medium placed on the medium placement unit to heat the medium.

4. The recording device according to claim 2, wherein the control unit controls, among the plurality of heating units, an overlapping heating unit and a neighboring heating unit to be in an identical heating state, the overlapping heating unit overlapping, in the first axial direction and the second axial direction, a high concentration region over a largest range, the high concentration region being a region of the medium where a largest amount of the liquid is discharged, the neighboring heating unit being adjacent to the overlapping heating unit in one of the first axial direction and the second axial direction.

5. The recording device according to claim 1, wherein the control unit uses a type of the medium as the condition.

6. The recording device according to claim 1, wherein the control unit uses, as the condition, an amount of liquid discharged from the discharging unit to the medium.

7. The recording device according to claim 1, wherein the control unit uses, as the condition, at least one of a temperature and a humidity in an environment in which the device is installed.

* * * * *